US005238361A

United States Patent [19]

Liqui

[11] Patent Number: 5,238,361

[45] Date of Patent: Aug. 24, 1993

[54] VEHICLE LIFTING AND SWIVELING DEVICE

[76] Inventor: Ursula Liqui, Warburger Strasse 72, D-4790 Paderborn, Fed. Rep. of Germany

[21] Appl. No.: 671,741

[22] PCT Filed: Jul. 22, 1989

[86] PCT No.: PCT/EP89/00862

§ 371 Date: Apr. 30, 1991

§ 102(e) Date: Apr. 30, 1991

[87] PCT Pub. No.: WO91/01263

PCT Pub. Date: Feb. 7, 1991

[51] Int. Cl.[5] ..... B66F 7/22

[52] U.S. Cl. ..... 414/678; 187/8.64; 187/8.45

[58] Field of Search ..... 414/678, 359, 361, 366, 414/371

[56] References Cited

U.S. PATENT DOCUMENTS

| | | | |
|---|---|---|---|
| 1,478,256 | 12/1923 | Reid | 414/678 |
| 1,640,293 | 8/1927 | Pitt . | |
| 3,674,252 | 7/1972 | Crabtree | 414/678 |
| 4,579,505 | 4/1986 | Lauritsen | 414/678 |
| 4,594,048 | 6/1986 | Sipla | 414/678 |

FOREIGN PATENT DOCUMENTS

| | | | |
|---|---|---|---|
| 206791 | 3/1955 | Australia | 414/678 |
| 509211 | 2/1952 | Belgium | 414/678 |
| 218013 | 4/1987 | European Pat. Off. . | |
| 285292 | 10/1988 | European Pat. Off. . | |
| 2349511 | 4/1975 | Fed. Rep. of Germany . | |
| 2533398 | 2/1976 | Fed. Rep. of Germany | 414/678 |
| 3125530 | 1/1983 | Fed. Rep. of Germany . | |
| 1129868 | 9/1956 | France | 414/678 |
| 598974 | 5/1978 | Switzerland . | |
| 178708 | 4/1922 | United Kingdom . | |
| 930486 | 7/1963 | United Kingdom | 414/678 |
| 1059378 | 2/1967 | United Kingdom . | |
| 2132983 | 7/1984 | United Kingdom . | |

*Primary Examiner*—Michael S. Huppert
*Assistant Examiner*—Gregory A. Morse
*Attorney, Agent, or Firm*—Browdy and Neimark

[57] ABSTRACT

This invention is directed to a lifting and swiveling device for a motor vehicle. The device has a lifting mechanism which is engaged to a wheel supported on the ground and swivel skids in the shape of a quarter circle. An automobile is securely fastened between the lifting mechanism and the swivel skids so that when a lifting arm of the lifting mechanism is moved upward the automobile is swiveled along with the swivel skids to permit easy access to the underside of the automobile.

10 Claims, 3 Drawing Sheets

VEHICLE LIFTING AND SWIVELING DEVICE

The invention relates to a lifting and swiveling device for a motor vehicle, having a lifting device supported on the ground and a lifting arm which can be fastened on the side and bottom of the motor vehicle, can be vertically positioned and driven by a gear device which can be locked in arbitrary lifting positions.

It is known to engage a motor vehicle laterally by means of a vertically positionable lifting arm, one side of which is supported on the ground, and to raise and lower it by operating the lifting arm. However, in this case the unilateral lift is limited, because swiveling of the vehicle cannot be allowed to reach the point where it would topple over. For this reason mounting operations underneath the vehicle while it is in the lifted position can only be performed to a limited degree if there is no grease pit available.

It is the object of the invention to disclose a lifting and swiveling device for motor vehicles which is simply constructed and permits the swiveling of the vehicle by almost 90° without the danger of toppling over.

This object is attained in that the lifting device has a lifting height corresponding to at least the maximum width of a vehicle, as well as a pair of swivel skids to be disposed on the vehicle opposite from the lifting device, each one consisting of a partial section approximately in the shape of a quarter circle with tangential projections, on which fastening and/or receiving devices are disposed on the inside of the circle, which are to be connected with supporting parts of the motor vehicle and the projections of which extend in the assembled state laterally upwards over the center of gravity of the motor vehicle.

The device is advantageously designed in such a way that it can be adapted to various vehicle widths and various wheel bases by means of telescopically fixable extensions.

Fastening of the device is advantageously made at the wheel hubs, since the wheel suspensions are designed for the loads occurring when the vehicle is swiveled. The fastenings at the wheel hubs are advantageously in the form of disks which can be matchingly bolted on and are releasably connected with the swivel skids.

The lifting device, which preferably is designed in the form of a lifting worm spindle, is advantageously supported with its lower end on a pair of rollers, which are connected with the ends of the swivel skids by means of a pulling connection, so that when the vehicle is lifted and swiveled the lifting device is at all times only slightly inclined and its lower part is pulled towards the vehicle during swiveling. Thus, the space for working on the underside of the vehicle remains relatively clear, flexing forces acting on the lifting device remain small and only minor lateral shearing forces are exerted on the vehicle.

The device can be applied to either side of the vehicle so that any area of the underside can be brought up to a convenient level.

The lifting device may be a hydraulic lift or a pneumatic lift as long as suitable driving means are available for it. Preferably a simple lifting worm spindle is used, which is operated from the top end via a bevel gear drive with a detent pin and a crank or preferably with a motor via a self-locking gear. In a preferred embodiment the connection between the gear and the motor is releasable and the motor connection is adapted to a commercially available drill, so that it can be clamped there.

For increased assurance against toppling over, a support is pivotably disposed between each one of the swivel skids, which extends vertically in the fully swiveled state and, in addition to the locked lifting device, prevents toppling of the vehicle.

The front and rear swivel skids are connected at their ends by means of an insertable connecting bar, so that the side of the motor vehicle to be swiveled down is protected during swiveling and conversely persons and objects are kept away from the side during swiveling. The connecting bar is disposed at such a level that the center of gravity of the vehicle is located at a considerable distance below it, so that in the swiveled state the vehicle does not accidentally continue to swivel and topples over on its roof.

The swivel skids are each made of a pair of bent pipes welded together with cross braces, which provide directional support for the fastening plates for the wheel hubs disposed between them. Because of this the entire device is stable, but light and requires little space in the disassembled state.

An advantageous embodiment is illustrated in FIGS. 1 to 4.

Figure 1:
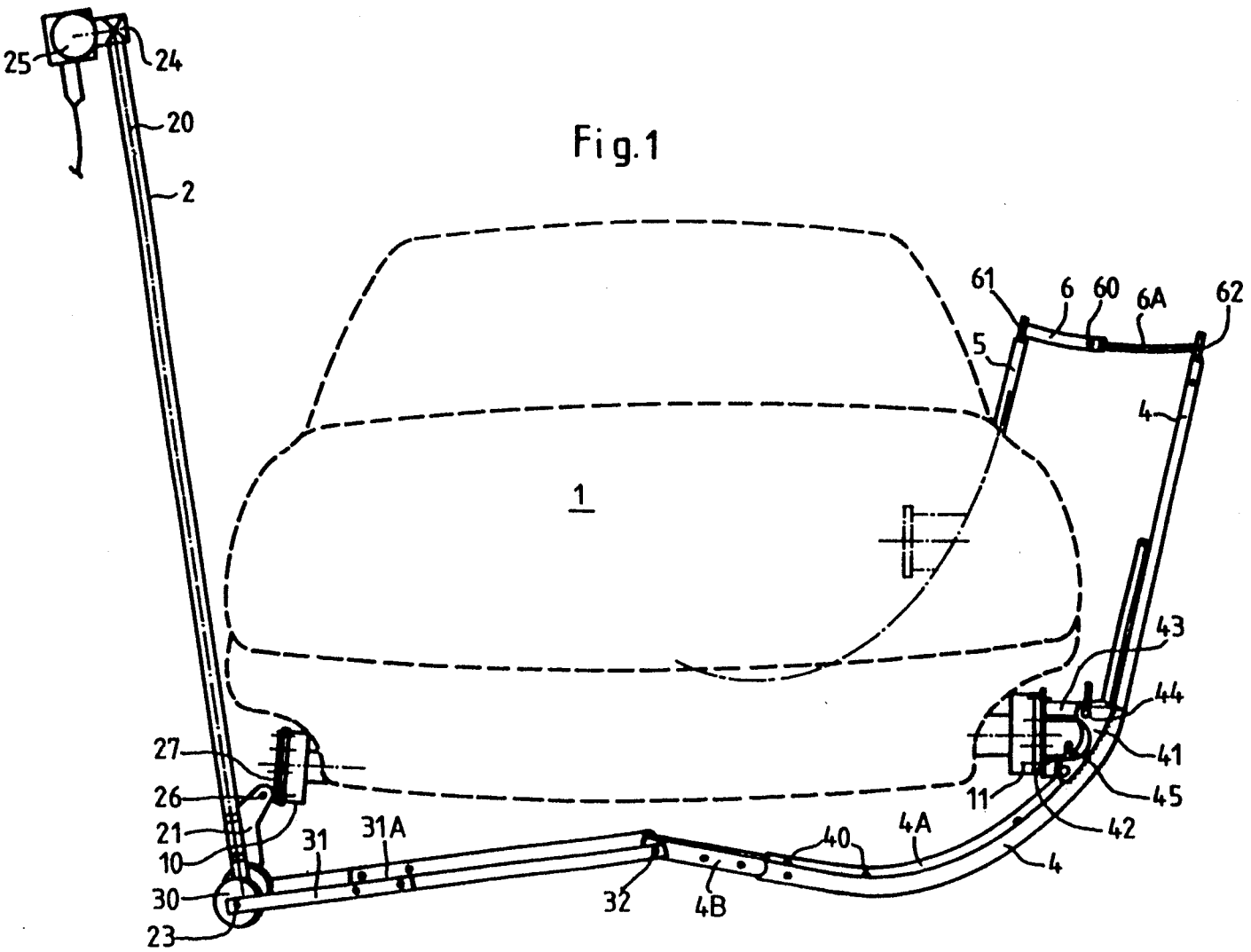
FIG. 1 is a crosswise view from the front of the device after being attached to a motor vehicle.

FIG. 1 is a crosswire front view of the device after mounting on the motor vehicle (1). A lifting arm (21) of the lifting device (2) is bolted to a wheel hub (10) by means of an angular support (27) fastened on it with a swivel joint (26). The lifting arm (21) is fastened with nuts on the worm spindle (20) located on the inside of the lifting device (2) and is displaceably seated in the surrounding housing. The lifting worm spindle (20) is connected at its upper end to an angular gear (24), on which a lift motor (25) is releasably flanged. On its lower end the lifting device (2) is seated with an axle (23) on two wheels (30), movable in the direction of the lifting arm (21) or the motor vehicle (1). Two parallel pulling rods (31, 31A) which are pivotably connected with the swiveling device (4, 4A), are fixed on the axle (23), approximately at the center below the motor vehicle (1), for which purpose the pulling rods (31, 31A) and the swivel skids (4, 4A) of the swiveling device can be adjusted to various vehicle widths by being telescopically extendible in length.

Figure 4:
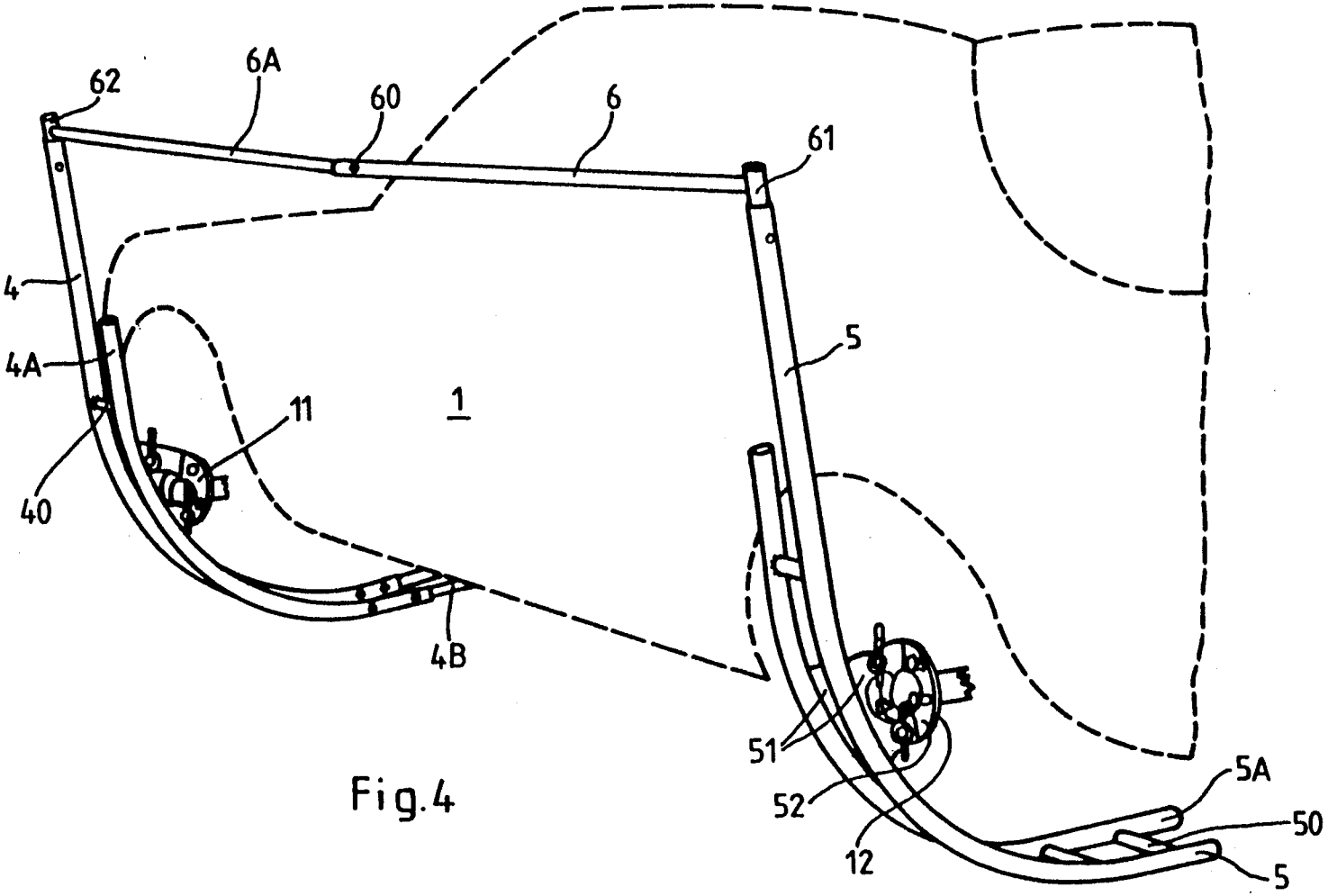
FIG. 4 is a lateral view of the device on a motor vehicle.

The swiveling device consists of a pair of swiveling skids (4, 5), of which the second swiveling skid (5) is only partially shown in FIG. 1 but is fully visible in FIG. 4. The pair of swivel skids (4, 5) is connected with a connecting bar (6, 6A) adaptable in its length in that pipe connectors (61, 62) are welded at right angles to the ends of the connecting bar (6, 6A), are inserted into the pipe-shaped ends of the swiveling skids (4, 5) and secured there. The connecting bar (6, 6A), which consists of pipes which fit into each other, is set to the appropriate length by means of a securing device (60) in the center.

The swiveling skids (4, 5) are bent in the approximate shape of a quarter circle and end in tangential projections on both ends. Each skid (4) and (5) are respectively paired with a parallel skid (4A) and (5A) and fixedly connected with it at a distance of approximately 20 cm by means of cross braces (40) and (50). The fastening device (41) is welded between the two skids (4, 4A) and disposed oriented towards the inside of the circles of the arcs. The fastening device (41) consists of a fastening plate (42), held on welded bars with angular supports (43) by means of insertable bolts (44). The bolts (44) are secured against sliding out with resilient safety pins (45). The fastening plate (41) is designed corresponding to the wheel hub (11) and is to be bolted to it in the same way as the respectively removed vehicle wheel. The fastening device (41) is disposed at one end of the arc of the circle and from there the one tangential end of the skid (4) extends, slightly inclined away from the vehicle, to as far as approximately three-quarters of the height of the vehicle, where the connecting bar (6, 6A) is inserted into the end of the skid (4). The radius of the arc of the circle approximately corresponds to one quarter to one third of the width of the vehicle. The tangential ends of the skids (4, 4A) lying under the vehicle can be extended by means of extendible pipes (4B) as far as the center of the vehicle, so that the ends of the pipes (4B) with the joint (32) of the pulling rod (31, 31A) are to be disposed approximately centrally under the vehicle (1).

Figures 2, 3:
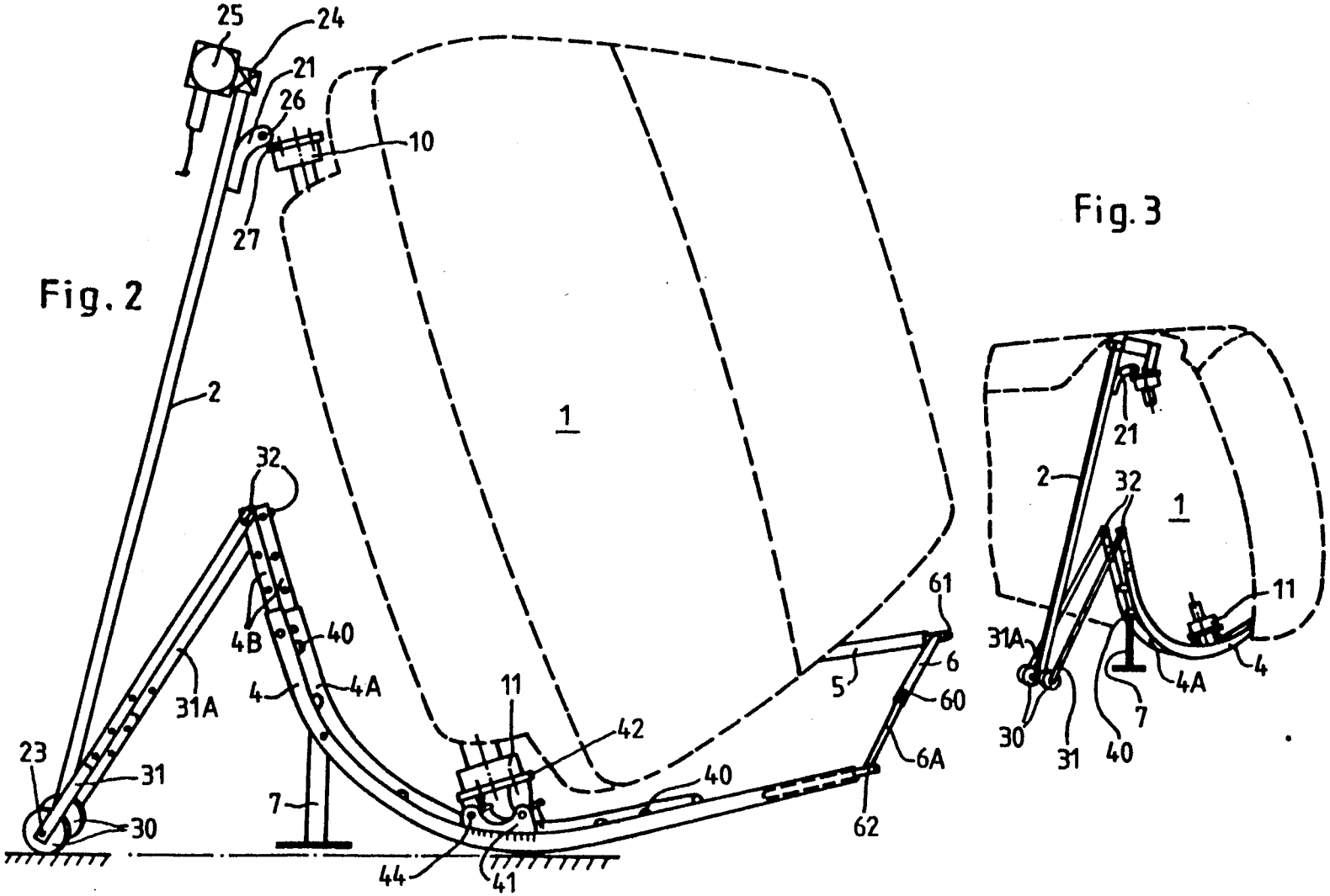
FIG. 2 is a crosswise view of the device with the motor vehicle in the swiveled position.
FIG. 3 is a bottom view of a motor vehicle together with the lifting part of the device.

FIG. 2 shows the device in the swiveled position where the end position has not quite been reached. The lifting arm (21) has been raised approximately to its upper end position by means of the lift motor (25) and in this way the vehicle (1) has been lifted on one side. The joint (32) at the end of the pipes (4B) of the swivel skid (4) has been lifted and because of this the pulling rod (31, 31A) has pulled the wheels (30) towards the vehicle (1). The lifting device (2) is only slightly tilted out of the vertical by this and is therefore exposed to only slight flexing forces, requires little lateral space and does not push the vehicle (1) towards one side. The lifting device (2) has an upper lifting limit which at least corresponds to a maximum vehicle width. A support (7) is pivoted out between the skids (4, 4A) which secures the vehicle (1) against unintended swiveling back because of its vertical position. It is also possible for the support to be releasable from the device and to be placed manually.

FIG. 3 shows the same swiveled position of the vehicle, where the viewing angle is directed more to the underside of the vehicle (1). In this way the paired disposition of the skid pipes (4, 4A), the pulling rod (31, 31A), the wheels (30) and the lifting device (2) located centrally in respect to this are clearly visible. The central position of the support (7) between the skids (4, 4A), which is seated with its upper end on a cross brace (40), is visible.

FIG. 4 shows the device in a perspective side view after installation. The pair of skids (5, 5A) located in the back is of the same kind as the front pair of skids (4, 4A) and is connected in the same way by means of cross braces (50) and a fastening device (51). A fastening plate (52) is also replaceably secured on the fastening device (51) via angle irons and bolts with resilient safety pins. The fastening plate (52) is bolted to the rear wheel hub (12).

The lifting device (2) can be applied at any corner of the vehicle, so that it makes possible optimal, unhampered access to the underside of the vehicle.

It is also possible to apply the lifting arm (21) to the conventional receiver holes for the jack on the frame of the chassis, instead of to the wheel hub 10, and the fastening device (41) of the swiveling skids (4, 4A) can also be equipped with angled receivers, instead of bolt plates (42), which are placed below the frame of the chassis or another component capable of support, for example the engine mounts, and laterally applied. In this case it is not necessary to remove the appropriate wheels.

I claim:

1. A lifting and swiveling device for a motor vehicle (1), comprising;

a lifting mechanism (2) supported at a lower end on the ground, said lifting mechanism (2) having a lifting arm (21) which can be fastened on the side and bottom of the motor vehicle (1), said lifting arm (21) vertically positioned and driven by a gear device (24, 25) which can be locked in arbitrary lifting positions, said lifting mechanism (2) having a lifting height corresponding to at least the maximum width of a vehicle, a pair of swivel skids (4, 5) to be disposed on the vehicle (1) opposite from said lifting mechanism (2), each of said pair of swivel skids (4, 5) having a partial section approximately in the shape of a quarter circle with tangential projections on which fastening and/or receiving means (41, 51) are disposed for connecting with supporting parts (11, 12) of the motor vehicle (1), said tangential projections extending in the untilted state above the center of gravity of the motor vehicle (1), wherein said lifting mechanism (2) is rotatably supported and engaged at said lower end on at least one wheel (30) so as to be moveable on the ground (21), and said lifting mechanism (2) is hingedly connected with the end of one of said pair of swiveling skids (4) extending underneath the vehicle (1) by means of a pulling connection (31, 31A).

wherein, when said lifting arm (21) is actuated to move upward, the vehicle (1) is swiveled with said pair of swivel skids (4, 5) while said lifting mechanism (2) rotates on said at least one wheel (30) toward the vehicle (1).

2. A lifting and swiveling device in accordance with claim 1, wherein said pulling connection (31, 31A) is a first pulling rod (31, 31A) which is longitudinally adjustable and fixable and that said one of said pair of swiveling skids (4) is longitudinally adjustable and fixable, so that a joint (32) connecting them is to be disposed approximately under the center of gravity of the motor vehicle (1).

3. A lifting and swiveling device in accordance with claim 1, wherein said pair of swiveling skids (4, 5) are releasably connected by means of a cross bar (6, 6A) disposed on the side of the motor vehicle (1), said cross bar (6, 6A) being longitudinally adjustable and fixable and fastened on the tangential projections.

4. A lifting and swiveling device in accordance with claim 3, wherein said cross bar (6, 6A) consists of pipes inserted into each other telescope-like, on the ends of which pipe connectors (61, 62) are placed at right angles, aid pipe connectors being inserted in the pipe-like projections of said swiveling skids (4, 5) and fixed there.

5. A lifting and swiveling device in accordance with claim 1, wherein parallel to each of said swiveling skids (4, 5) a further skid (4A, 5A) is disposed, which is connected by cross braces (40, 50) with each one of said swiveling skids (4, 5), and that between these pairs of swiveling skids (4, 4A; 5, 5A) the fastening devices (41, 51) are disposed on the inside of the circle of the arc and are welded on.

6. A lifting and swiveling device in accordance with claim 5, wherein a second pulling rod (31A) is hinged to one of the further skids (4A, 5A), which extends parallel with said first pulling rod (31, 31A), and that the two pulling rods (31, 31A) are fastened to the end of an axle (23) of the wheel (30) and a further wheel (30).

7. A lifting and swiveling device in accordance with claim 1, wherein the fastening devices (41, 51) are each releasably connected via socket pins (44), held with resilient pin safeties (45), with a plate support (42, 52), which can be bolted to wheel hubs (11, 12) of the motor vehicle (1).

8. A lifting and swiveling device in accordance with claim 1, wherein the lifting arm (21) has on its end an angled support (27) which can be bolted to one of the wheel hubs (11, 12).

9. A lifting and swiveling device in accordance with claim 1, wherein the lifting mechanism (2) contains a lifting worm spindle (20) with the lifting arm (21) secured thereon, in that the lifting arm (21) is guided vertically displaceably in a slit of the lifting mechanism (2), and in that at the upper end of the spindle (20) a lockable or self-locking gear (24) is disposed, to which a drive motor (25) is connected.

10. A lifting and swiveling device in accordance with claim 9, wherein the drive motor (25) is releasably connected with the gear (24), that the gear (24) is an angular gear and that a commercially available drill can be connected to it as the drive motor.

* * * * *